US007716045B2

(12) United States Patent
Capman

(10) Patent No.: US 7,716,045 B2
(45) Date of Patent: May 11, 2010

(54) METHOD FOR QUANTIFYING AN ULTRA LOW-RATE SPEECH CODER

(75) Inventor: François Capman, Versailles (FR)

(73) Assignee: Thales (FR)

( * ) Notice: Subject to any disclaimer, the term of this patent is extended or adjusted under 35 U.S.C. 154(b) by 828 days.

(21) Appl. No.: 11/578,663

(22) PCT Filed: Apr. 14, 2005

(86) PCT No.: PCT/EP2005/051661

§ 371 (c)(1),
(2), (4) Date: Oct. 18, 2006

(87) PCT Pub. No.: WO2005/114653

PCT Pub. Date: Dec. 1, 2005

(65) Prior Publication Data

US 2007/0219789 A1 Sep. 20, 2007

(30) Foreign Application Priority Data

Apr. 19, 2004 (FR) ..... 04 04105

(51) Int. Cl.
*G10L 19/00* (2006.01)

(52) U.S. Cl. ..... 704/219

(58) Field of Classification Search ..... 704/219–223
See application file for complete search history.

(56) References Cited

U.S. PATENT DOCUMENTS 5,806,027 A * 9/1998 George et al. ..... 704/230
5,890,108 A * 3/1999 Yeldener ..... 704/208
6,081,776 A * 6/2000 Grabb et al. ..... 704/219
6,134,520 A * 10/2000 Ravishankar ..... 704/222
6,263,307 B1 * 7/2001 Arslan et al. ..... 704/226
6,377,915 B1 * 4/2002 Sasaki ..... 704/206
6,475,145 B1 * 11/2002 Baylor ..... 600/309
7,286,982 B2 * 10/2007 Gersho et al. ..... 704/223
7,315,815 B1 * 1/2008 Gersho et al. ..... 704/223

OTHER PUBLICATIONS

Ulpu Sinervo et al: "Multi-Mode Matrix Quantizer for Low Bit Rate LSF Quantization", Eurospeech, Sep. 2003, pp. 1073-1076, XP007006802.

Stachurski J et al: "High quality MELP coding at bit-rates around 4 kb/s", IEEE International Conference on Acoustics, Speech, and Signal Processing, Proceedings, Mar. 15, 1999, pp. 485-488, XP010327975.

(Continued)

*Primary Examiner*—Michael N Opsasnick
(74) *Attorney, Agent, or Firm*—Lowe Hauptman Ham & Berner, LLP

(57) ABSTRACT

A method of coding and decoding speech for voice communications using a vocoder with very low bit rate includes an analysis part for the coding and the transmission of the parameters of the speech signal and a synthesis part for the reception and the decoding of the parameters transmitted and the reconstruction of the speech signal. The method comprises: grouping together the voicing parameters, pitch, gains, LSF coefficients over N consecutive frames to form a superframe, and performing a vector quantization of the voicing information in the course of each superframe by formulating a classification using the information on the chaining in terms of voicing existing over 2 consecutive elementary frames.

14 Claims, 5 Drawing Sheets

OTHER PUBLICATIONS

Nandkumar S et al: "Robust speech mode based LSF vector quantization for low bit rate coders" IEEE International Conference on Acoustics, Speech, and Signal Processing, Proceedings, May 12, 1998, pp. 41-44, XP010279049.

Padellini M et al: "Codage de la parole a trè bas debit par indexation d'unitès de taille variable", Recontres Jeunes Chercheurs en Parole, XX, XX, Sep. 23, 2003, pp. 1-3, XP002285303.

"A Mixed Excitation LPC Vocoder Model for Low Bit Rate Speech Coding", A.V. McCree, T.P. Barnwell III, IEEE Transactions on Speech and Audio Processing, vol. 3, No. 4, pp. 242-250, Jul. 1995.

"A 2.4 kbits/s MELP Coder Candidate for the New US Federal Standard", A.V. McCree, K. Truong, E.B. George, T.P. Barnwell III, Viswanathan V., Proceedings of IEEE ICASSP, pp. 200-203, 1996.

"MELP: The New Federal Standard at 2400 BPS", L. Supplee, R. Cohn, J. Collura, A.V. McCree, Proceedings of IEEE ICASSP, pp. 1591-1594, 1997.

"The 1200 and 2400 bit/s NATO Interoperable Narrow Band Voice Coder", NATO STANAG No. 4591.

* cited by examiner

METHOD FOR QUANTIFYING AN ULTRA LOW-RATE SPEECH CODER

CROSS-REFERENCE TO RELATED APPLICATIONS

The present Application is based on International Application No. PCT/EP2005/051661, filed on Apr. 14, 2005, which in turn corresponds to France Application No. 04/04105 filed on Apr. 19, 2004, and priority is hereby claimed under 35 USC §119 based on these applications. Each of these applications are hereby incorporated by reference in their entirety into the present application.

BACKGROUND OF THE INVENTION

Field of the Invention

The invention relates to a method of coding speech. It applies in particular to the realization of vocoders with very low bit rate, of the order of 600 bits per second.

It is used for example for the MELP coder (Mixed Excitation Linear Prediction coder), described for example in one of the references [1,2,3,4].

The method is for example implemented in communications by satellite, telephone over the Internet, static responders, voice pagers, etc.

The objective of these vocoders is to reconstruct a signal which is as close as possible, in the sense of perception by the human ear, to the original speech signal, using the lowest possible binary bit rate.

To attain this objective, most vocoders use a totally parametrized model of the speech signal. The parameters used relate to: the voicing which describes the harmonic character of the voiced sounds or the stochastic character of the unvoiced sounds, the fundamental frequency of the voiced sounds also known by the term "PITCH", the temporal evolution of the energy as well as the spectral envelope of the signal for exciting and parametrizing the synthesis filters.

In the case of the MELP coder, the spectral parameters used are the LSF coefficients (Line Spectral Frequencies) derived from an analysis by linear prediction, LPC (Linear Predictive Coding). The analysis is done for a conventional bit rate of 2400 bit/sec every 22.5 ms.

The additional information extracted during the modeling is:

- the fundamental frequency or pitch,
- the gains,
- the sub-band voicing information,
- the Fourier coefficients calculated on the residual signal after linear prediction.

The document by ULPU SINERVO et al. discloses a procedure making it possible to quantize the spectral coefficients. In the procedure proposed, a multi-frame matrix quantizer is used to exploit the correlation between the LSF parameters of adjacent frames.

The document by STACHURSKI relates to a coding technique for bit rates of about 4 kbits/s. The coding technique uses an MELP model in which the complex coefficients are used in the speech synthesis. In this document the significance of the parameters is analyzed.

The object of the present invention is, in particular, to extend the MELP model to the bit rate of 600 bits/sec. The parameters employed are for example, the pitch, the LSF spectral coefficients, the gains and the voicing. The frames are grouped for example into a superframe of 90 ms, that is to say 4 consecutive frames of 22.5 ms of the initial scheme (scheme customarily used).

A bit rate of 600 bits/sec is obtained on the basis of an optimization of the quantization scheme for the various parameters (pitch, LSF coefficient, gain, voicing).

SUMMARY OF THE INVENTION

The invention relates to a method of coding and decoding speech for voice communications using a vocoder with very low bit rate comprising an analysis part for the coding and the transmission of the parameters of the speech signal, such as the voicing information per sub-band, the pitch, the gains, the LSF spectral parameters and a synthesis part for the reception and the decoding of the parameters transmitted and the reconstruction of the speech signal. It is characterized in that it comprises at least the following steps:

- grouping together the voicing parameters, pitch, gains, LSF coefficients over N consecutive frames to form a superframe,
- performing a vector quantization of the voicing information for each superframe by formulating a classification using the information on the chaining in terms of voicing existing over a sub-multiple of N consecutive elementary frames, the voicing information makes it possible specifically to identify classes of sounds for which the allocation of the bit rate and the associated dictionaries will be optimized,
- coding the pitch, the gains and the LSF coefficients by using the classification obtained.

The classification is for example formulated by using the information on the chaining in terms of voicing existing over 2 consecutive elementary frames.

The method according to the invention makes it possible advantageously to offer reliable coding for low bit rates.

BRIEF DESCRIPTION OF THE DRAWINGS

Other characteristics and advantages of the present invention will be more apparent on reading the description of an exemplary embodiment given by way of illustration, with appended figures which represent.

DETAILED DESCRIPTION OF THE DRAWINGS

The example detailed hereafter, by way of wholly nonlimiting illustration, relates to an MELP coder suitable for the bit rate of 600 bits/sec.

The method according to the invention pertains notably to the encoding of the parameters which make it possible to best reproduce all the complexity of the speech signal, with a minimum of bit rate. The parameters employed are for example: the pitch, the LSF spectral coefficients, the gains and the voicing. The method notably calls upon a procedure of vector quantization with classification.

Figure 1:
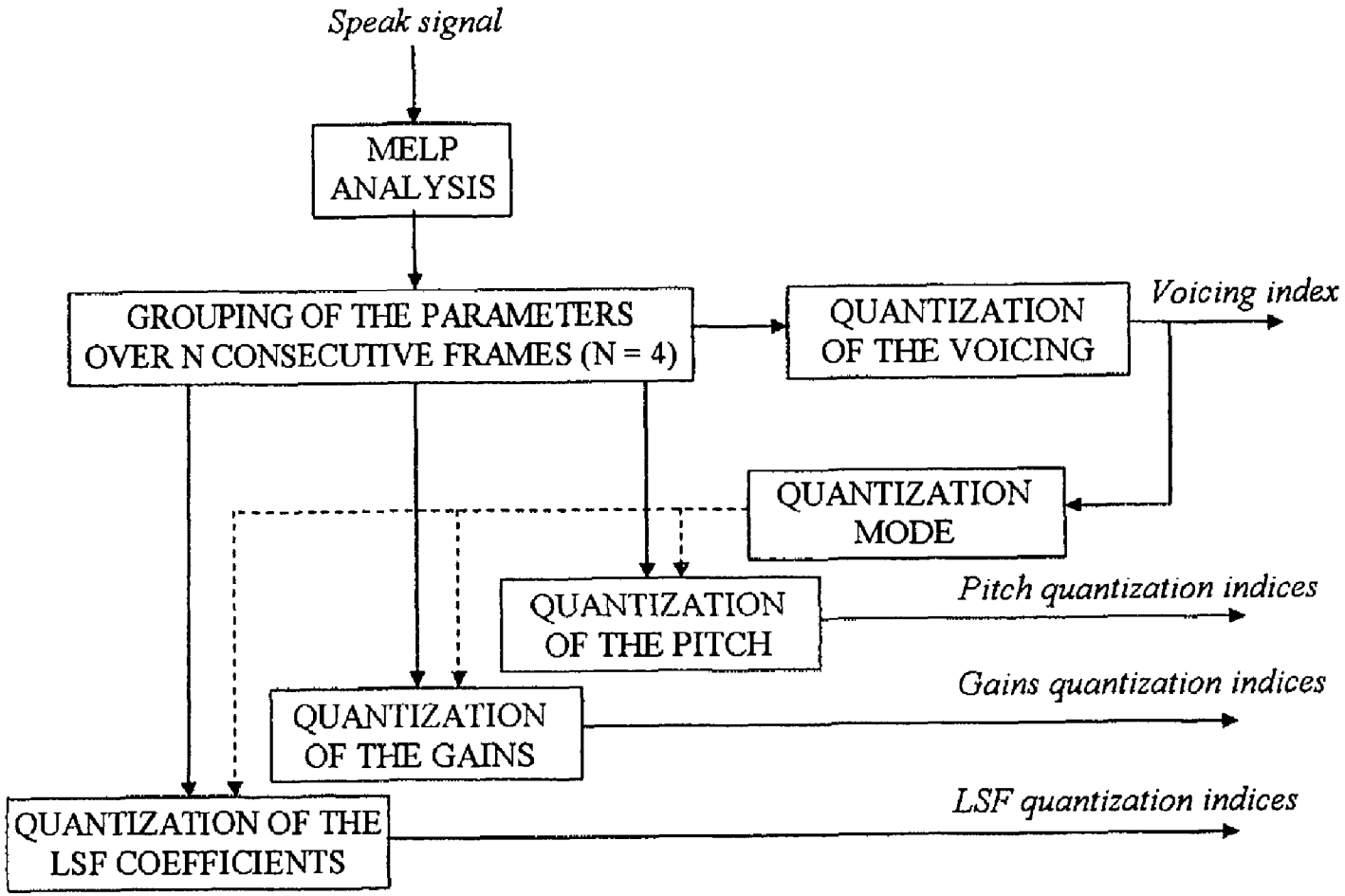
FIG. 1 a general diagram of the method according to the invention for the coder part, FIG. 2 the functional diagram of the vector quantization of the voicing information, FIGS. 3 and 4 the functional diagram of the vector quantization of the pitch, FIG. 5 the functional diagram of the vector quantization of the spectral parameters (LSF coefficients), FIG. 6 the functional diagram of multi-stage vector quantization, FIG. 7 the functional diagram of the vector quantization of the gains, FIG. 8 a diagram applied to the decoder part.

FIG. 1 diagrammatically shows globally the various implementations at the level of a speech coder. The method according to the invention proceeds in 7 main steps.

Step of Analysis of the Speech Signal

Step 1 analyzes the signal by means of an algorithm of the MELP type known to the person skilled in the art. In the MELP model, a voicing decision is taken for each frame of 22.5 ms and for 5 predefined frequency sub-bands.

Step of Grouping of the Parameters

For step 2, the method groups together the selected parameters: voicing, pitch, gains and LSF coefficients over N consecutive frames of 22.5 ms so as to form a superframe of 90 ms. The value N=4 is chosen for example so as to form a compromise between the possible reduction of the binary bit rate and the delay introduced by the quantization method (compatible with the current interleaving and error corrector coding techniques).

Figure 2:
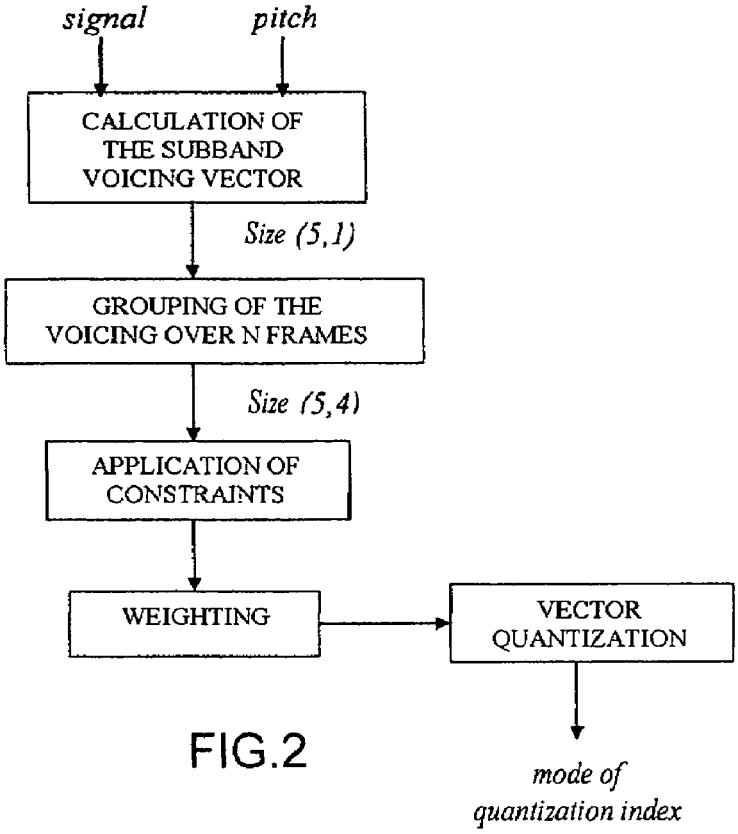

Step of Quantization of the Voicing Information—Detailed in FIG. 2

At the horizon of a superframe, the voicing information is therefore represented by a matrix with binary components (0: unvoiced; 1: voiced) of size (5*4), 5 MELP sub-bands, 4 frames.

The method uses a vector quantization procedure on n bits, with for example n=5. The distance used is a Euclidean distance weighted so as to favor the bands situated at low frequencies. We use for example as weighting vector [1.0; 1.0; 0.7; 0.4; 0.1].

The quantized voicing information makes it possible to identify classes of sounds for which the allocation of the bit rate and the associated dictionaries will be optimized. This voicing information is thereafter implemented for the vector quantization of the spectral parameters and of the gains with preclassification.

The method can comprise a step of applying constraints. During the training phase, the method for example calls upon the following 4 vectors [0,0,0,0,0], [1,0,0,0,0], [1,1,1,0,0], [1,1,1,1,1] indicating the voicing from the low band to the high band. Each column of the voicing matrix, associated with the voicing of one of the 4 frames constituting the superframe, is compared with each of these 4 vectors, and replaced by the closest vector for the training of the dictionary.

During the coding, the same constraint is applied (choice of the above 4 vectors) and the vector quantization QV is carried out by applying the dictionary found previously. The voicing indices are thus obtained.

In the case of the MELP model, the voicing information forming part of the parameters to be transmitted, the classification information is therefore available at the level of the decoder without cost overhead in terms of bit rate.

As a function of the quantized voicing information, dictionaries are optimized. For this purpose the method defines for example 6 voicing classes over a horizon of 2 elementary frames. The classification is for example determined by using the information on the chaining in terms of voicing existing over a sub-multiple of N consecutive elementary frames, for example over 2 consecutive elementary frames.

Each superframe is therefore represented over 2 voicing classes. The 6 voicing classes thus defined are for example:

| Class | | Characteristics of the class |
|---|---|---|
| $1^{st}$ class | UU | Two consecutive unvoiced frames |
| $2^{nd}$ class | UV | An unvoiced frame followed by a voiced frame |
| $3^{rd}$ class | VU | A voiced frame followed by an unvoiced frame |
| $4^{th}$ class | $VV_1$ | Two consecutive voiced frames, with at least one weak voicing frame (1, 0, 0, 0, 0), the other frame being of greater or equal voicing |
| $5^{th}$ class | $VV_2$ | Two consecutive voiced frames, with at least one mean voicing frame (1, 1, 1, 0, 0), the other frame being of greater or equal voicing |
| $6^{th}$ class | $VV_3$ | Two consecutive voiced frames, where each of the frames is strongly voiced, that is to say where only the last sub-band may be unvoiced (1, 1, 1, 1, x) |

A dictionary is optimized for each voicing level. The dictionaries obtained are estimated in this case over a horizon of 2 elementary frames.

The vectors obtained are therefore of size 20=2*10 LSF coefficients, according to the order of the analysis by linear prediction in the initial MELP model.

Step of Definition of the Quantization Modes, Detailed in FIG. 1

On the basis of these various quantization classes, the method defines 6 quantization modes determined according to the chaining of the voicing classes:

| Mode | Chaining of the classes |
|---|---|
| $1^{st}$ mode | Unvoiced classes (UU) |
| $2^{nd}$ mode | Unvoiced class (UU) and mixed class (UV, VU) |
| $3^{rd}$ mode | Mixed classes (UV, VU) |
| $4^{th}$ mode | Voiced classes (VV) and unvoiced classes (UU) |
| $5^{th}$ mode | Voiced classes (VV) and mixed classes (UV, VU) |
| $6^{th}$ mode | Voiced classes (VV) |

Table 1 groups together the various quantization modes as a function of the voicing class and table 2 the voicing information for each of the 6 quantization modes.

TABLE 1

| | Class 1: UU | Class 2: UV | Class 3: VU | Class 4, 5, 6: VV |
|---|---|---|---|---|
| Class 1: UU | 1 | 2 | 2 | 4 |
| Class 2: UV | 2 | 3 | 3 | 5 |
| Class 3: VU | 2 | 3 | 3 | 5 |
| Class 4, 5, 6: VV | 4 | 5 | 5 | 6 |

TABLE 2

| | Voicing information |
|---|---|
| Mode 1 | (UU\|UU) |
| Mode 2 | (UU\|UV), (UU\|VU), (UV\|UU), (VU\|UU) |
| Mode 3 | (UV\|UV), (UV\|VU), (VU\|UV), (VU\|VU) |
| Mode 4 | (VV\|UU), (UU\|VV) |
| Mode 5 | (VV\|UV), (VV\|VU), (UV\|VV), (VU\|VV) |
| Mode 6 | (VV\|VV) |

In order to limit the size of the dictionaries and to reduce the search complexity, the method implements a quantization procedure of multi-stage type, such as the procedure MSVQ (Multi Stage Vector Quantization) known to the person skilled in the art.

In the example given, a superframe consists of 4 vectors of 10 LSF coefficients and the vector quantization is applied for each grouping of 2 elementary frames (2 sub-vectors of 20 coefficients).

There are therefore at least 2 multi-stage vector quantizations whose dictionaries are deduced from the classification (table 1).

Figure 3:
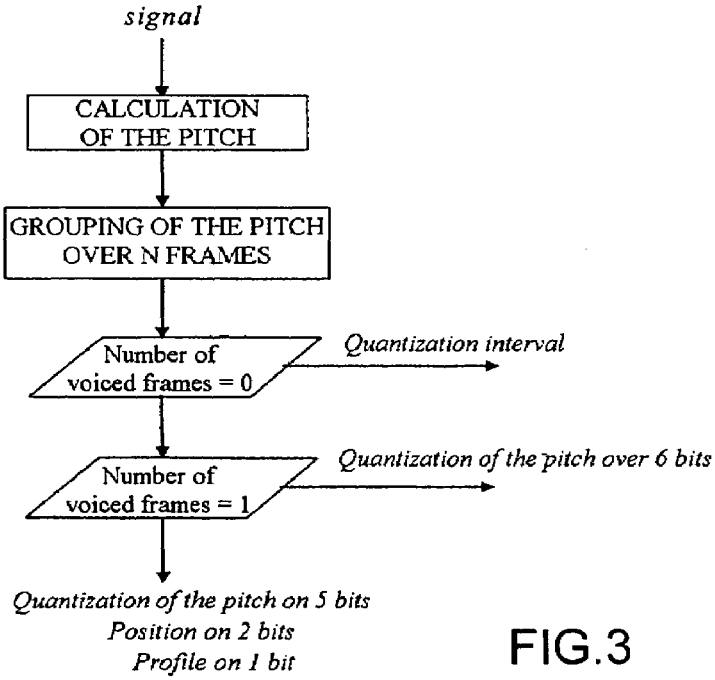
Figure 4:
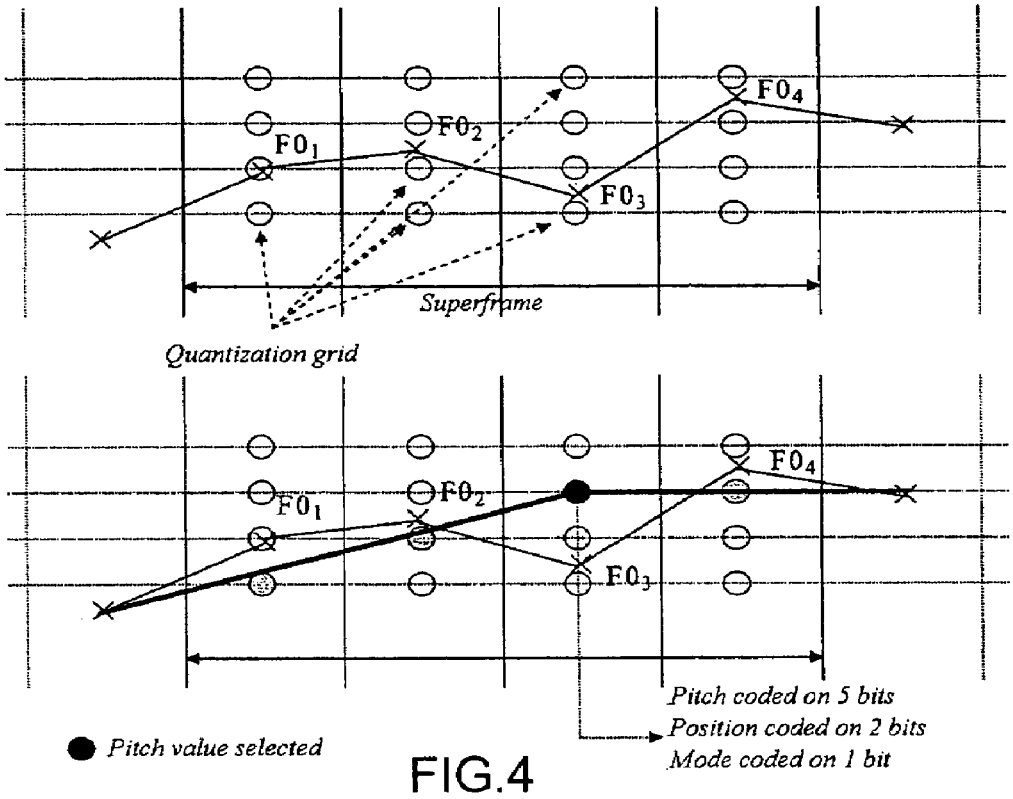

Step of Quantization of the Pitch, FIGS. 3 and 4

The pitch is quantized in a different manner according to the mode.

In the case of mode 1 (unvoiced, number of voiced frames equal to 0), no pitch information is transmitted.

In the case of mode 2, a single frame is regarded as voiced and identified by the voicing information. The pitch is then represented on 6 bits (scalar quantization of the pitch period after logarithmic compression).

In the other modes:

5 bits are used to transmit a pitch value (scalar quantization of the pitch period after logarithmic compression), 2 bits are used to position the pitch value on one of the 4 frames 1 bit is used to characterize the evolution profile.

FIG. 4 shows diagrammatically the profile of evolution of the pitch. The pitch value transmitted, its position and the evolution profile are determined by minimizing a least squares criterion over the pitch trajectory estimated in the analysis. The trajectories considered are obtained for example by linear interpolation between the last pitch value of the preceding superframe and the pitch value which will be transmitted. If the pitch value transmitted is not positioned on the last frame, the indicator of the evolution profile makes it possible to complete the trajectory either by keeping the value attained, or by returning to the value of "initial pitch" (the last pitch value of the preceding superframe). The whole set of positions is considered, as well as all the pitch values lying between the quantized pitch value immediately lower than the minimum pitch estimated over the superframe and the quantized pitch value immediately greater than the maximum pitch estimated over the superframe.

Figure 5:
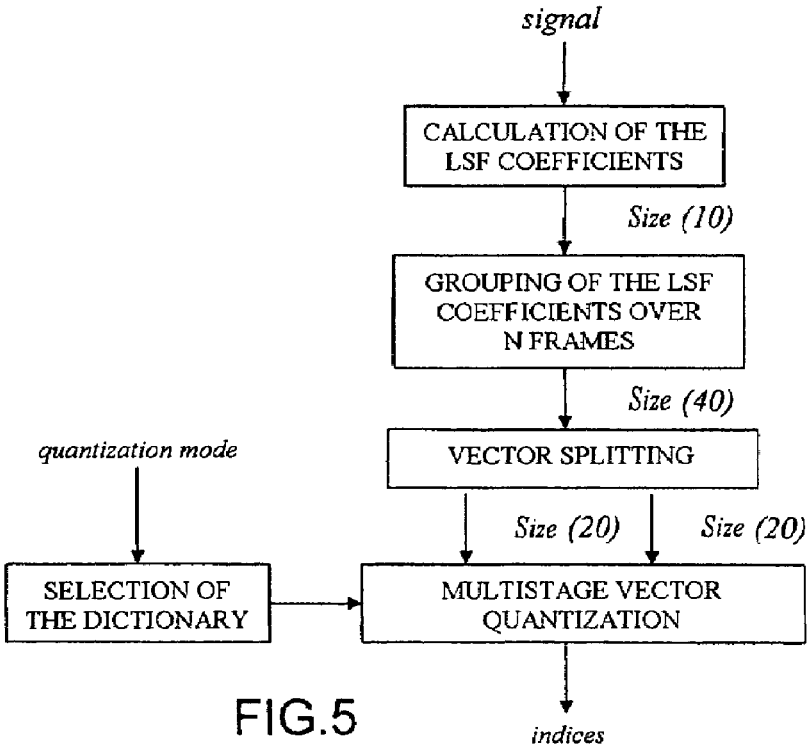
Figure 6:
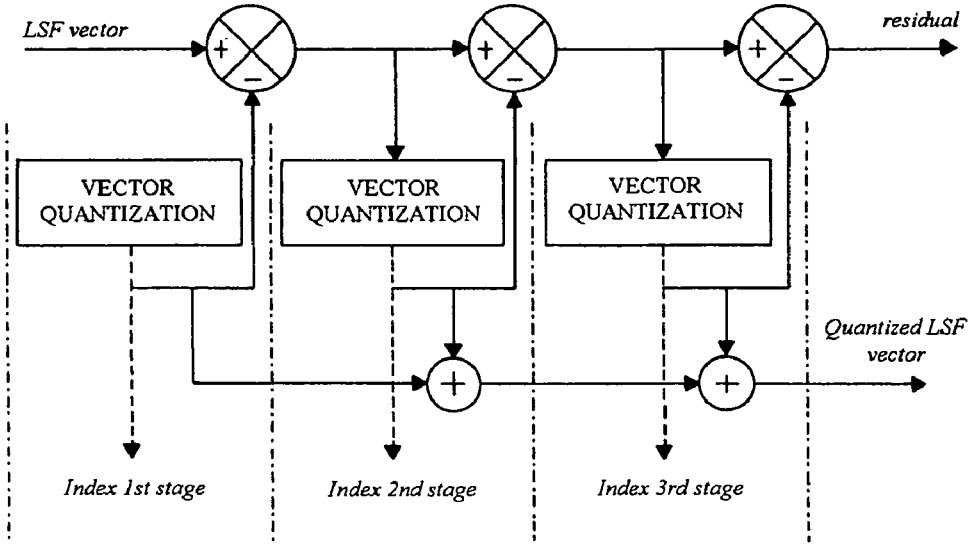

Step of Quantization of the Spectral Parameters, of the LSF Coefficients, Detailed in FIGS. 5, 6

Table 3 gives the allocation of the bit rate for the spectral parameters for each of the quantization modes. The distribution of the bit rate for each stage is given between parentheses.

TABLE 3

| Quantization mode | Allocation of bit rate (MSVQ) |
|---|---|
| Mode 1 | (6, 4, 4, 4) + (6, 4, 4, 4) = 36 bits |
| Mode 2 | (6, 4, 4) + (7, 5, 4) = 30 bits |
| Mode 3 | (6, 5, 4) + (6, 5, 4) = 30 bits |
| Mode 4 | (6, 4, 4) + (7, 5, 4) = 30 bits |
| Mode 5 | (6, 5, 4) + (6, 5, 4) = 30 bits |
| Mode 6 | (7, 5, 4) + (7, 5, 4) = 32 bits |

In each of the 6 modes, the bit rate is allocated by priority to the greater voicing class, the concept of greater voicing corresponding to a greater or equal number of voiced sub-bands.

For example, in mode 4, the two consecutive unvoiced frames will be represented on the basis of the dictionary (6, 4, 4) while the two consecutive voiced frames will be represented by the dictionary (7, 5, 4). In mode 2 the two mixed consecutive frames are represented by the dictionary (7,5,4) and the two consecutive unvoiced frames by the dictionary (6,4,4).

Table 4 groups together the memory size associated with the dictionaries.

TABLE 4

| Class | Mode | MSVQ type | Number of vectors | Memory size |
|---|---|---|---|---|
| UU | Mode 1 | MSVQ (6, 4, 4, 4) | (64 + 16 + 16 + 16) | 2240 words |
| UU | Modes 2, 4 | MSVQ (6, 4, 4) | Included in (6, 4, 4, 4) | 0 |
| UV | Mode 2 | MSVQ (7, 5, 4) | (128 + 32 + 16) | 3520 words |
| UV | Mode 3, 5 | MSVQ (6, 5, 4) | (64 + 32 + 16) | 2240 words |
| VU | Mode 2 | MSVQ (7, 5, 4) | (128 + 32 + 16) | 3520 words |
| VU | Mode 3, 5 | MSVQ (6, 5, 4) | (64 + 32 + 16) | 2240 words |
| VV | Mode 4, 6 | MSVQ (7, 5, 4) | (128 + 32 + 16) * 3 | 10 560 words |
| VV | Mode 5 | MSVQ (6, 5, 4) | (64 + 32 + 16) * 3 | 6720 words |
| | | | | TOTAL = 31 040 words |

Figure 7:
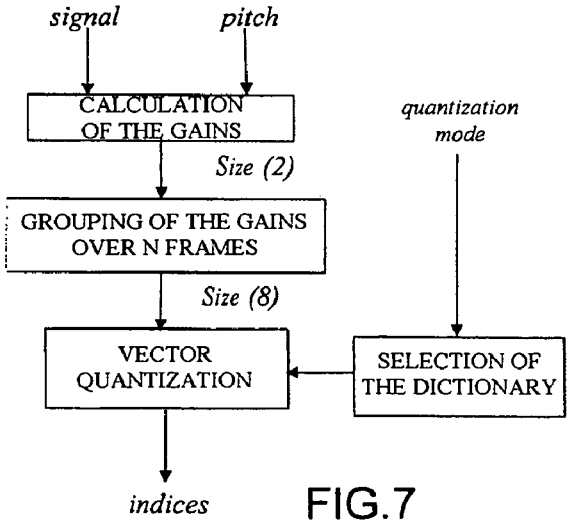

Step of Quantization of the Gain Parameter, Detailed in FIG. 7

A vector of m gains with m=8 is for example calculated for each superframe (2 gains per frame of 22.5 ms, scheme used customarily for the MELP). m can take any value, and is used to limit the complexity of the search for the best vector in the dictionary.

The method uses a vector quantization with preclassification. Table 5 groups together the bit rates and the memory size associated with the dictionaries.

The method calculates the gains, then it groups together the gains over N frames, with N=4 in this example. It thereafter uses the vector quantization and the predefined classification mode (on the basis of the voicing information) to obtain the indices associated with the gains. The indices being thereafter transmitted to the decoder part of the system.

TABLE 5

| Mode | Allocation of MSVQ/VQ bit rate | MSVQ type | Number of vectors | Memory size |
|---|---|---|---|---|
| Modes 1, 2 | (7, 6) = 13 bits | MSVQ (7, 6) | (128 + 64) | 1536 words |
| Modes 3, 4, 5 | (6, 5) = 11 bits | MSVQ (6, 5) | (64 + 32) | 768 words |
| Mode 6 | (9) = 9 bits | VQ (9) | 512 | 4096 words |
| | | | | TOTAL = 6400 words |

The abbreviation VQ corresponds to vector quantization and MSVQ multi-stage vector quantization procedure.

Evaluation of the Bit Rate

Table 6 groups together the allocation of the bit rate for the realization of the 600 bit/sec speech coder of MELP type a superframe of 54 bits (90 ms).

TABLE 6

| Mode | Voicing | LSF | Pitch | Gain |
|---|---|---|---|---|
| 1 (54 bits) | 5 bits | (6, 4, 4, 4) + (6, 4, 4, 4) 32 bits | 0 | (7, 6) 13 bits |
| 2 (54 bits) | 5 bits | (6, 4, 4) + (7, 5, 4) 30 bits | 6 bits | (7, 6) 13 bits |
| 3 (54 bits) | 5 bits | (6, 5, 4) + (6, 5, 4) 30 bits | 8 bits | (6, 5) 11 bits |
| 4 (54 bits) | 5 bits | (6, 4, 4) + (7, 5, 4) 30 bits | 8 bits | (6, 5) 11 bits |
| 5 (54 bits) | 5 bits | (6, 5, 4) + (6, 5, 4) 30 bits | 8 bits | (6, 5) 11 bits |
| 6 (54 bits) | 5 bits | (7, 5, 4) + (7, 5, 4) 32 bits | 8 bits | 9 bits |

Figure 8:
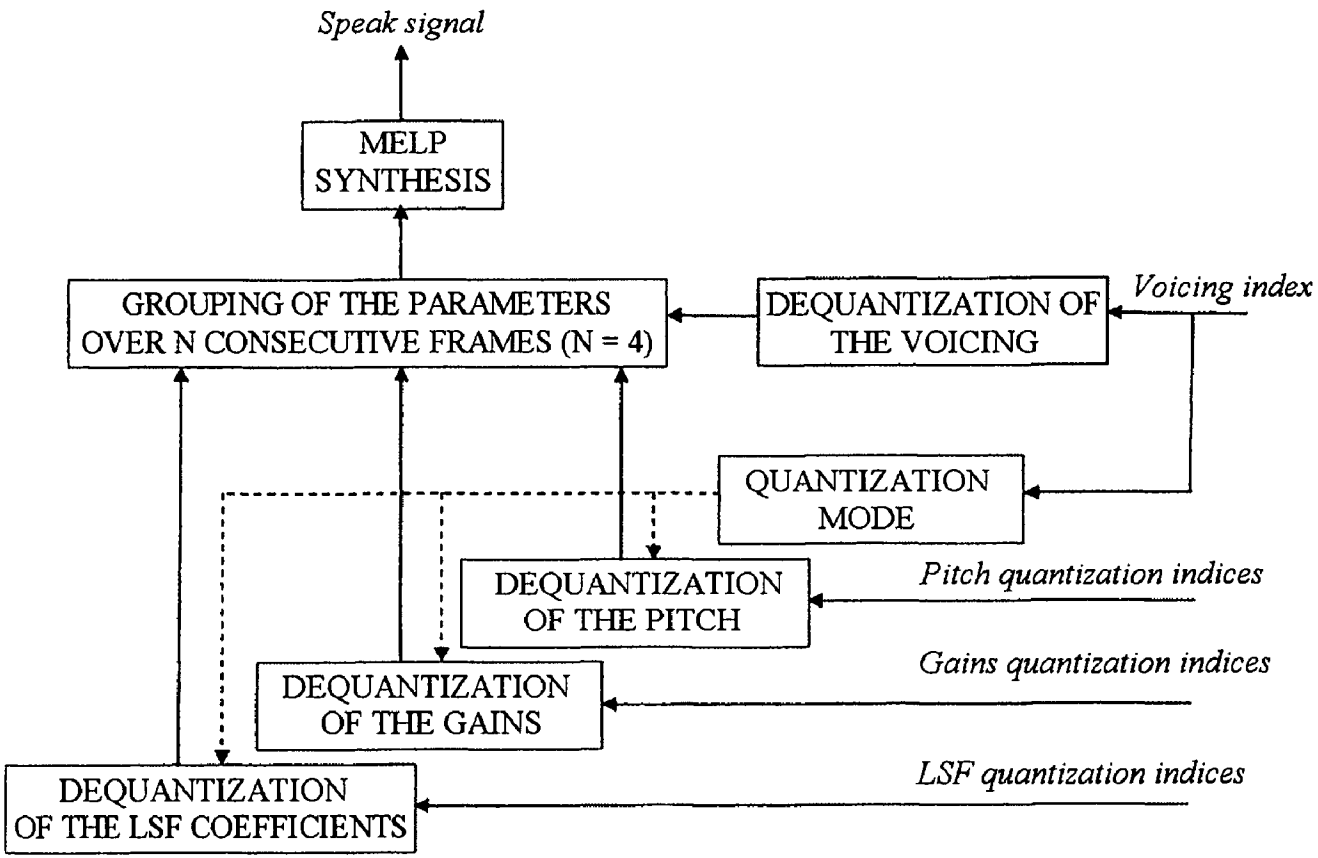

FIG. 8 represents the scheme at the level of the decoding part of the vocoder. The voicing index transmitted by the coder part is used to generate the quantization modes. The indices of voicing, of quantization of the pitch, of the gains and of the LSF spectral parameters transmitted by the coder part are de-quantized using the quantization modes obtained. The various steps are performed according to a scheme similar to that described for the coder part of the system. The various de-quantized parameters are thereafter grouped together before being transmitted to the synthesis part of the decoder so as to retrieve the speech signal.

The invention claimed is:

1. A method of coding and decoding speech for voice communications using a vocoder with very low bit rate comprising an analysis part for the coding and the transmission of the parameters of the speech signal, such as the voicing information per sub-band, the pitch, the gains, the LSF spectral parameters and a synthesis part for the reception and the decoding of the parameters transmitted and the reconstruction of the speech signal comprising executing the following steps on an audio processor:

grouping together the voicing parameters, pitch, gains, LSF coefficients over N consecutive frames to form a superframe, performing a vector quantization of the voicing information for each superframe by formulating a classification using the information on the chaining in terms of voicing existing over a sub-multiple of N consecutive elementary frames, the voicing information makes it possible specifically to identify classes of sounds for which the allocation of the bit rate and the associated dictionaries will be optimized, the classification is performed on voicing classes over a horizon of 2 elementary frames, the classes are 6 in number and include:

a $1^{st}$ class comprising two consecutive unvoiced frames (UU);

a $2^{nd}$ class comprising an unvoiced frame followed by a voiced frame (UV);

a $3^{rd}$ class comprising a voiced frame followed by an unvoiced frame (VU);

a $4^{th}$ class comprising two consecutive voiced frames with at least one weak voicing frame and the other frame being of greater or equal voicing ($VV_4$);

a $5^{th}$ class comprising two consecutive voiced framed with at least one mean voicing frame and the other frame being of greater or equal voicing ($VV_2$); and a $6^{th}$ class comprising two consecutive voiced frames wherein each of the frames is strongly voiced and only a last sub band may be unvoiced ($VV_3$);

coding the pitch, the gains and the LSF coefficients by using the classification obtained.

2. The method as claimed in claim 1, wherein it uses a quantization procedure of multi-stage type to limit the size of the dictionaries and reduce the search complexity.

3. The method as claimed in claim 1, wherein to quantize the LSF spectral parameters, the bit rate is allocated by priority to the greater voicing class.

4. The use of the method as claimed in claim 1 with a 600 bits/s speech coder of MELP type.

5. The method as claimed in claim 1, wherein to quantize the gain parameter a vector of at least 8 gains is calculated for each superframe.

6. The method as claimed in claim 5, wherein the modes and the bit rates allocation (MSVQ/VQ) are as follows:

modes 1 and 2 have 13 bits allocated as (7,6);

modes 3-5 have 13 bits allocated as (6,5); and mode 6 has 9 bits allocated as (9).

7. The method as claimed in claim 1, wherein for the quantization of the pitch, it comprises at least the following steps:

if all the frames are unvoiced, no pitch information is transmitted, if a frame is voiced, its position is identified by the voicing information and its value is coded, if the number of voiced frames is greater than or equal to 2, a pitch value is transmitted, the pitch value is positioned on one of the N frames, the evolution profile is characterized.

8. The method as claimed in claim 7, wherein the pitch value transmitted, its position and the evolution profile are determined by using a least squares criterion over the pitch trajectory estimated in the analysis.

9. The method as claimed in claim 8, wherein the trajectories are determined by linear interpolation between the last pitch value of the preceding superframe and the pitch value which will be transmitted, if the pitch value transmitted is not positioned on the last frame, then the trajectory is completed by keeping the value attained or else by returning to the last pitch value of the preceding superframe.

10. The method as claimed in claim 1, wherein it defines 6 quantization modes according to the chaining of the voicing classes.

11. The method as claimed in claim 10, wherein it uses a quantization procedure of multi-stage type to limit the size of the dictionaries and reduce the search complexity.

12. The method as claimed in claim 10, wherein it uses a quantization procedure of multi-stage type to limit the size of the dictionaries and reduce the search complexity.

13. The method as claimed in claim 10, wherein N=4 and the quantization modes include six modes comprising:

mode 1 defined as (UU|UU);

mode 2 defined as (UU|UV), (UU|VU), (UV|UU), (VU|UU);

mode 3 defined as (UV|UV), (UV|VU), (VU|UV), (VU|VU);

mode 4 defined as (VV|UU), (UU|VV);

mode 5 defined as (VV|UV), (VV|VU), (UV|VV), (VU|VV); and mode 6 defined as (VV|VV).

14. The method as claimed in claim 13, wherein Multi Stage Vector Quantization (MSVQ) of the bit rate for each of the quantization modes includes:

a quantization mode 1 that allocates 36 bits as (6,4,4,4)+(6,4,4,4);

a quantization mode 2 that allocates 30 bits as (6,4,4)+(7, 5,4);

a quantization mode 3 that allocates 30 bits as (6,5,4)+(6, 5,4);

a quantization mode 4 that allocates 30 bits as (6,4,4)+(7, 5,4);

a quantization mode 5 that allocates 30 bits as (6,5,4)+(6, 5,4); and a quantization mode 6 that allocates 32 bits as (7,5,4)+(7, 5,4).

* * * * *